US007841489B2

(12) United States Patent
Gilbertson et al.

(10) Patent No.: US 7,841,489 B2
(45) Date of Patent: Nov. 30, 2010

(54) CONTAINER SEALING SYSTEM

(75) Inventors: Mark A. Gilbertson, Prairie du Sac, WI (US); Scott G. Manke, Sun Prairie, WI (US)

(73) Assignee: Masterchem Industries, LLC, Imperial, MO (US)

( * ) Notice: Subject to any disclaimer, the term of this patent is extended or adjusted under 35 U.S.C. 154(b) by 938 days.

(21) Appl. No.: 10/577,498

(22) PCT Filed: Oct. 28, 2004

(86) PCT No.: PCT/US2004/036060

§ 371 (c)(1),
(2), (4) Date: Mar. 6, 2007

(87) PCT Pub. No.: WO2005/042365

PCT Pub. Date: May 12, 2005

(65) Prior Publication Data

US 2007/0272706 A1 Nov. 29, 2007

Related U.S. Application Data

(60) Provisional application No. 60/515,156, filed on Oct. 28, 2003.

(51) Int. Cl.
*B67D 1/16* (2006.01)

(52) U.S. Cl. ..... 222/111; 222/109; 222/570

(58) Field of Classification Search ..... 222/108, 222/109, 111, 566, 567, 569–571, 574, 1; 220/699–702

See application file for complete search history.

(56) References Cited

U.S. PATENT DOCUMENTS 2,690,281 A 9/1954 Livingstone
2,763,402 A 9/1956 Livingstone (Continued)

FOREIGN PATENT DOCUMENTS

WO WO 02/085713 A1 10/2002

OTHER PUBLICATIONS

International Search Report for PCT/US2004/036060, date of mailing, Mar. 24, 2005, 2 pages.

*Primary Examiner*—J. Casimer Jacyna
(74) *Attorney, Agent, or Firm*—Foley & Lardner LLP

(57) ABSTRACT

A container having a knit line. The container comprises a body defining a partially enclosed volume having an access opening defined by a neck, the neck defining a pocket. An insert is coupled to the neck. The insert comprises an outer wall configured to fit within the opening of the container and defining the periphery of the insert. The outer wall has an upper edge and a lower edge, with the upper edge including an annular lip extending radially outward to prevent the insert from being pushed too far into or through the neck. The tooth extends from the lip and is configured to insert into a notch defined by the neck of the container. An upstanding spout is located within the outer wall. A bottom wall connects the lower edge of the outer wall and the spout to form a channel between the outer wall and the spout. The lip includes a first portion having a first radius and a second portion having a second radius, wherein the first radius is larger than the second radius with the first portion forming a seal at the knit line of the container when the cover is threaded onto the neck.

27 Claims, 8 Drawing Sheets

U.S. PATENT DOCUMENTS

| | | | | |
|---|---|---|---|---|
| 2,889,079 | A | | 6/1959 | Livingstone |
| 3,300,104 | A | | 1/1967 | Burt |
| 3,318,496 | A | | 5/1967 | Ayotte et al. |
| 3,369,710 | A | | 2/1968 | Lucas |
| 3,397,824 | A | | 8/1968 | Ganung et al. |
| 4,550,862 | A | | 11/1985 | Barker et al. |
| 4,671,421 | A | | 6/1987 | Reiber et al. |
| 4,696,416 | A | | 9/1987 | Muckenfuhs et al. |
| 4,706,829 | A | | 11/1987 | Li |
| 4,773,560 | A | | 9/1988 | Kittscher |
| 4,917,268 | A | | 4/1990 | Campbell et al. |
| 4,917,270 | A | | 4/1990 | Simon |
| 4,984,714 | A | | 1/1991 | Sledge |
| 4,993,605 | A | | 2/1991 | Del'Re |
| 5,108,009 | A | | 4/1992 | Davidson et al. |
| 5,435,467 | A | | 7/1995 | Ekkert et al. |
| 5,454,489 | A | | 10/1995 | Vesborg |
| 5,462,202 | A | * | 10/1995 | Haffner et al. ..... 222/109 |
| 5,649,650 | A | | 7/1997 | Klauke |
| 6,209,762 | B1 | * | 4/2001 | Haffner et al. ..... 222/570 |
| 6,398,076 | B1 | | 6/2002 | Giblin et al. |
| 6,464,106 | B1 | | 10/2002 | Giblin et al. |

* cited by examiner

CONTAINER SEALING SYSTEM

CROSS REFERENCE TO RELATED APPLICATIONS

This application is related to and claims priority to U.S. Provisional Patent Application 60/515,156, filed Oct. 28, 2003, which is incorporated herein by this reference.

FIELD

The present invention relates generally to the field of sealing systems for containers and more specifically to a sealing system for a container having a spout.

BACKGROUND

Plastic containers for viscous liquids such as laundry detergent and paint have been disclosed, including a reclamation spout that is placed within the opening of the container. In a non-circular container, it is desirable to specifically locate the spout relative to the container such that the pouring edge of the spout is positioned in a desired location. A number of attempts have been made to specifically locate the spout relative to the container.

A spout locator is disclosed in U.S. Pat. No. 4,984,714, to Sledge entitled Spouted Bottle. In sledge, typically the cap creates a seal with the container by at least partially contacting the neck and/or spout.

In U.S. Pat. No. 6,209,762, to Haffner, et al entitled DISPENSING PACKAGE AND METHOD OF USE, a lug formed on a neck engages a slot formed in the spout to retain the spout within the neck.

During the molding process of the container, material can build up on or adjacent to the mold knit line. The material build-up can inhibit or prevent a seal from forming as the container cap is screwed down on to the container neck and spout fitment.

It would be desirable to provide a container with a spout and cap that may be positively positioned relative to the container and also provide a seal between the cap and the container and spout to prevent the liquid from leaking, particularly near the container knit line.

SUMMARY

Figure 1:
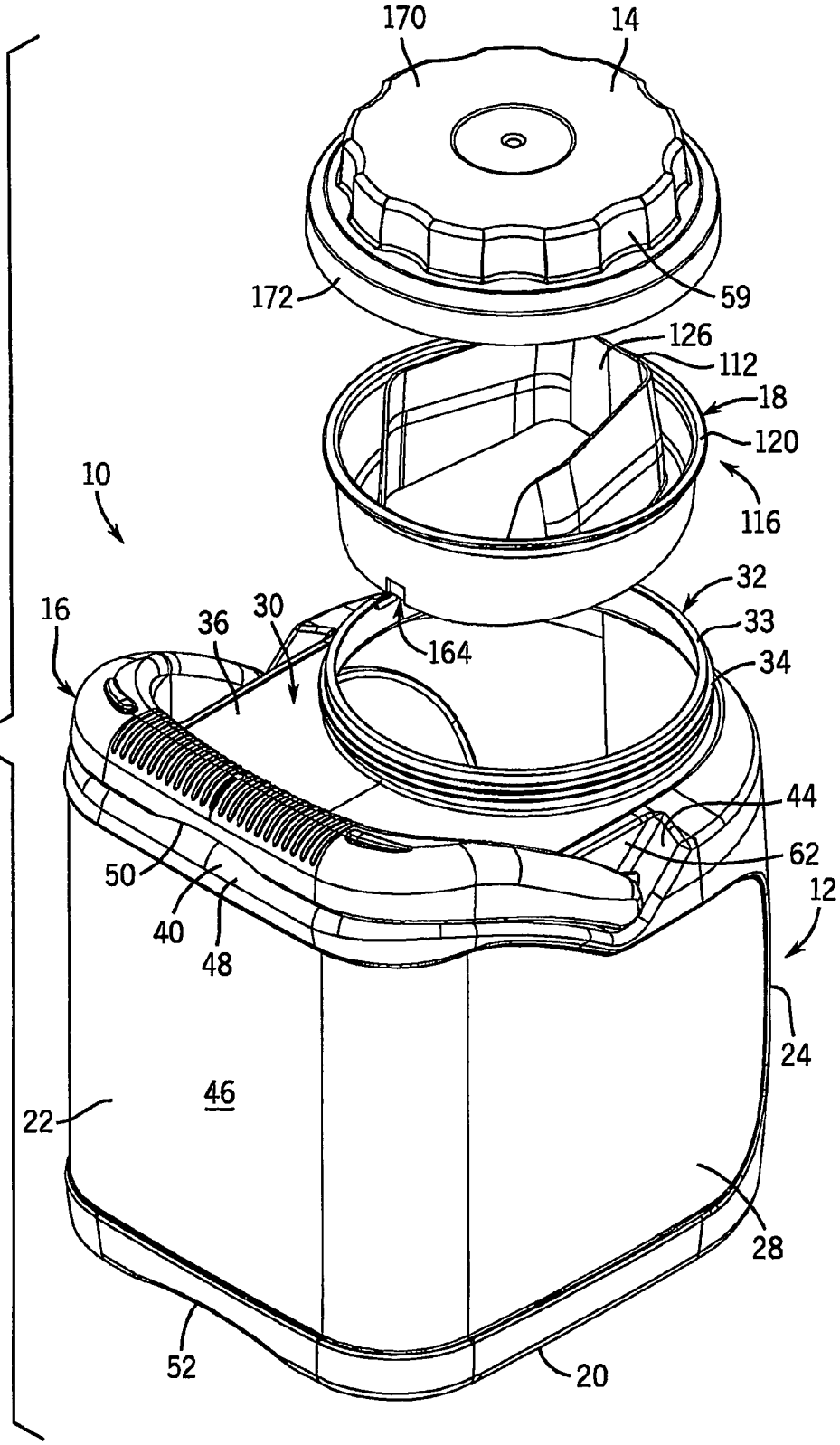
FIG. 1 is an exploded perspective view of an exemplary embodiment of a container including a container sealing system.

There is provided an insert for a container having a knit line on the container body, a neck defining an opening in the body and a cover configured to threadingly engage the neck. The insert includes an outer wall configured to fit within the opening of the container and defining the periphery of the insert. The outer wall has an upper edge and a lower edge, with the upper edge including an annular lip extending radially outward to prevent the insert from being pushed too far into or through the neck. An upstanding spout located within the outer wall. A bottom wall is connecting the lower edge of the outer wall and the spout to form a channel between the outer wall and the spout. The lip includes a first portion having a first radius and a second portion having a second radius, wherein the first radius is larger than the second radius with the first portion forming a seal at the knit line of the container when the cover is threaded onto the neck. Another embodiment of the insert includes a tooth extending from the lip and configured to insert into a pocket defined by the neck of the container. The tooth may be a spaced distance from the outer wall of the insert.

There is also provided a container having a knit line. The container comprises a body defining a partially enclosed volume having an access opening defined by a neck, the neck defining a pocket. An insert is coupled to the neck. The insert comprises an outer wall configured to fit within the opening of the container and defining the periphery of the insert. The outer wall has an upper edge and a lower edge, with the upper edge including an annular lip extending radially outward to prevent the insert from being pushed too far into or through the neck. The tooth extends from the lip and is configured to insert into a pocket defined by the neck of the container. An upstanding spout is located within the outer wall. A bottom wall connects the lower edge of the outer wall and the spout to form a channel between the outer wall and the spout. The lip includes a first portion having a first radius and a second portion having a second radius, wherein the first radius is larger than the second radius with the first portion forming a seal at the knit line of the container when the cover is threaded onto the neck.

There is also provided a method for aligning and sealing the container having a knit line, a neck defining an opening in the container, and a cover configured to threadingly engage the neck. The method comprises the steps of providing an insert having an annular lip extending radially outward. Configuring the insert to fit within the opening of the container. Configuring the annular lip with a first portion having a first radius and a second portion having a second radius, wherein the first radius is larger than the second radius with the first portion forming a seal at the knit line of the container when the cover is threaded onto the neck. Providing a tooth on an annular lip. Configuring the tooth to insert into a pocket defined in the neck, wherein the tooth/pocket combination aligns the first portion of the insert with the knit line of the container. Another embodiment of the method includes the step of configuring the insert to define a spout.

There is also provided an insert for a container having a body defining a volume, a neck defining an opening in the body and a cover configured to threadingly engage the neck. The insert comprises an outer wall configured to fit within the opening of the container and defining the periphery of the insert. The outer wall has an upper edge including a lip extending radially outward from the upper edge to prevent the insert from being pushed to far into or through the neck. The insert also has a lower edge. The lip includes one of a tooth and notch configured to engage one of the notch and tooth formed in the neck. An upstanding spout is located within the outer wall. A bottom wall connects the lower edge of the outer wall and the spout to form a channel between the outer wall and the spout, wherein the tooth/notch combination inhibits rotation of the insert in the opening and aligns the insert in a preselected orientation.

There is provided an insert configured to fit in an opening of a container, with the insert having an upper edge with a first portion extending radically further than a second portion to effect a seal of the opening when a cap is coupled to the container to close the opening.

DETAILED DESCRIPTION OF EXEMPLARY EMBODIMENTS

Figure 2:
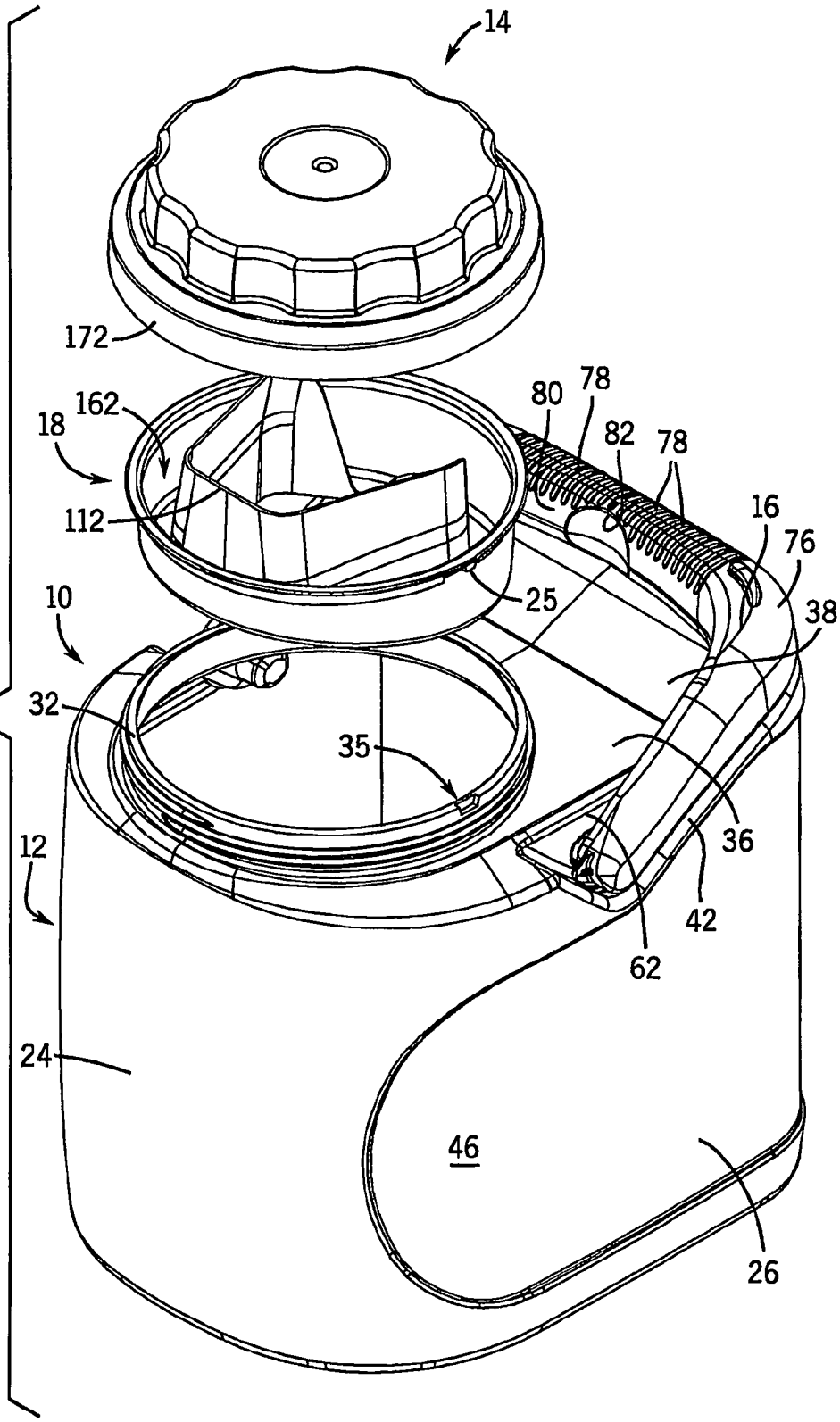
FIG. 2 is an exploded perspective view of the container illustrated in FIG. 1.

Referring to FIGS. 1 and 2, a container 10 includes a body 12, a cap 14, a handle 16, and a spout insert 18. Body 12 has a general D-shape configuration and includes a bottom 20, a front wall 22, an opposing rear wall 24, and first and second side walls 26, 28. Body 12 also includes a top 30 having a neck 32 provided with external threads 34. The use of the terms front and rear refer to the position that the container may be placed on a retail shelf. While the container may be placed on the retail shelf in any orientation, front wall 22 provides a planar surface for a display label. While the container is in actual use, the location of spout 18 may be considered the front; however, for purposes of this description, spout 18 is closer to back wall 24. Reference is made to U.S. patent application Ser. No. 10/627,200, filed Jul. 25, 2003directed to a spout, which is incorporated herein by this reference.

Top 30 also includes a first land region 36 proximate neck 32, a second angled transitional region 38 and an upper region 40 configured to support handle 16. Land region 36 may be flat or parallel to a horizontal plane as illustrated or may have another profile. Adjacent sides 26, 28 and top 30 is a pair of handle support regions 42 that begin lower than first land region 36 and angle upward to transition region 38 and upper region 40. Region 42 as measured from a vertical plane in one embodiment is preferably about 45 degrees. Additionally, a back handle support region 44 as described below supports handle 16 in a rearward position closer to spout 18. Back handle support region 44 as measured from a vertical plane is preferably about 60 degrees. The angle of support region 44 in combination with the size of handle 16 prohibits handle 16 from contacting spout 18 or the rear portion of body 12, and still provides clearance over cap 14 to lift handle 16. Accordingly, other angles of region 44 may be used.

Body 12 also includes a recessed region 46 that extends across the substantially flat front wall 22 and around at least a portion of the curved back wall 24. Recessed region 46 may receive a label that could be applied during the forming operation such as in-mold labeling for a plastic formed component. A label may also be applied to the container after the container has been formed.

A front edge 48 of upper support region 40 may be curved or beveled as a transition into front wall 22. This transition edge 48 provides an easy surface for a user to be able to grasp handle 16. While the front edge 48 may have a recessed region permitting a user to slide his fingers under the handle, handle 16 may also include a handle recess 50 either in addition to a recess on edge 48 or independent of such a recess. A disruption in the interface between handle 16 and top 30 and front wall 22 allows a user to easily grasp and raise handle 16.

A bottom recess 52 is located on the bottom edge of container 10 between front wall 22 and bottom 20. Bottom recess 52 allows a user to reach under the bottom of container 10 while container 10 is resting on a supporting surface or on another container 10. Bottom recess 52 further facilitates pouring paint from container 10. Bottom recess 52 is connected to a finger recess or well (not shown) extending inwardly into container 10 from bottom 20. The finger recess may be located immediately proximate bottom recess 52 or may be connected to bottom recess 52 with a recess channel (not shown). Bottom recess 52, the recess channel, and the finger recess may be configured to comfortably rest on a user's hand to aid the user in pouring the content from the container. While one hand is holding handle 16, a second hand may be grasping the bottom by use of the bottom recess 52, the finger recess, and the recess channel either together or in any combination of these features.

The height of bottom recess 52 as measured from a support surface of the container, or as measured from the lowest support features on bottom 20, may be sufficient to allow a user to insert his fingers or portion of his finger in the bottom recess, the channel recess, and/or the finger recess. This would allow a user in combination with the handle to easily lift the container from a support surface such as a retail outlet shelf, table or another container.

Bottom 20 may also include a cap recess (not shown) that is configured to receive a portion of cap 14 when like containers 10 are stacked on one another. The cap recess may include a periphery having features that match those of cap 14 such as indentations to match recesses 59 that are provided on cap 14. Alternatively, the cap recess may have an outer diameter that matches or exceeds the outer diameter of cap 14. The container 10 can be manufactured by any well known procedure, for example by blow molding from plastic.

Figure 3:
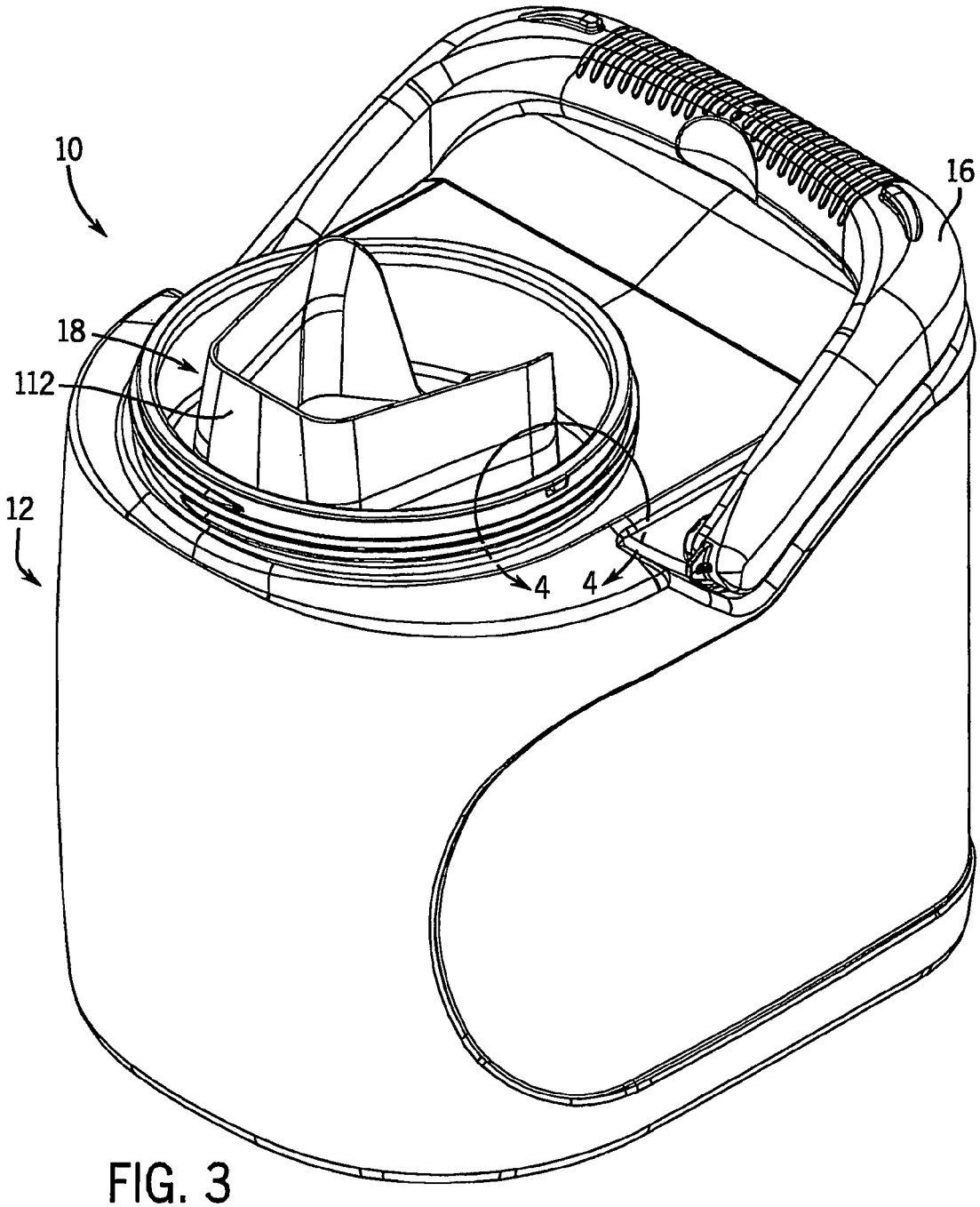
FIG. 3 is a perspective view of an exemplary embodiment of a container having a notch formed in the neck and configured to receive a tooth formed in the spout insert.
Figure 6:
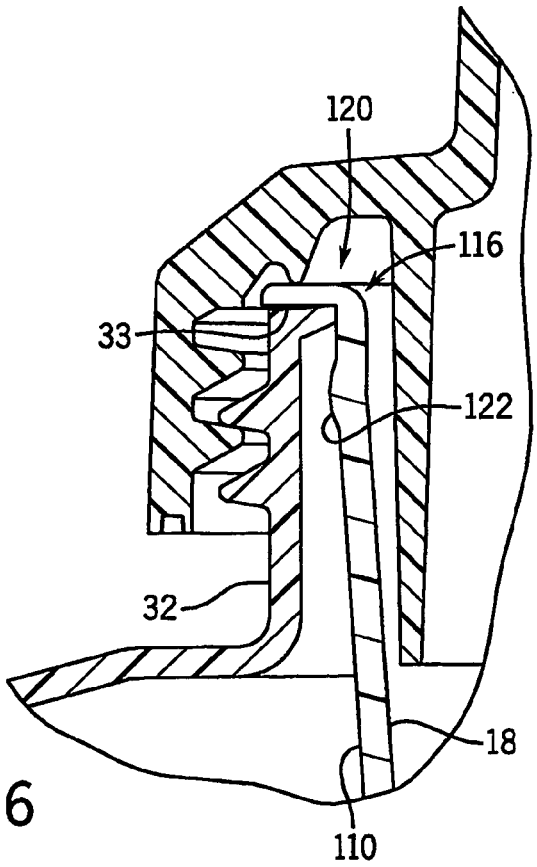
FIG. 6 is a partial cross-section detail view of the container sealing system illustrated in FIG. 5.
Figure 5:
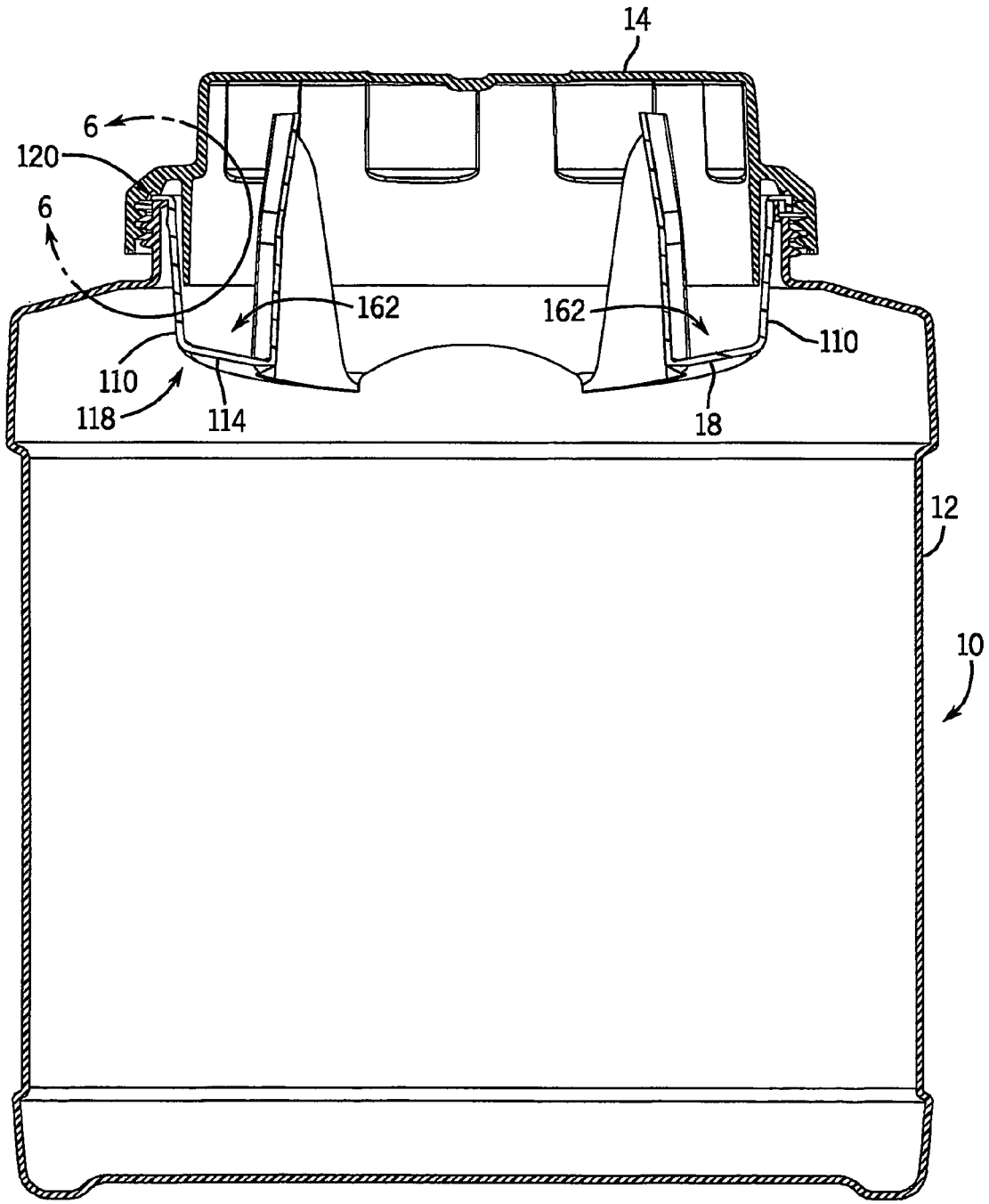
FIG. 5 is a cross-section of an exemplary embodiment of a container including a spout insert and cover and having a container sealing system.
Figure 7:
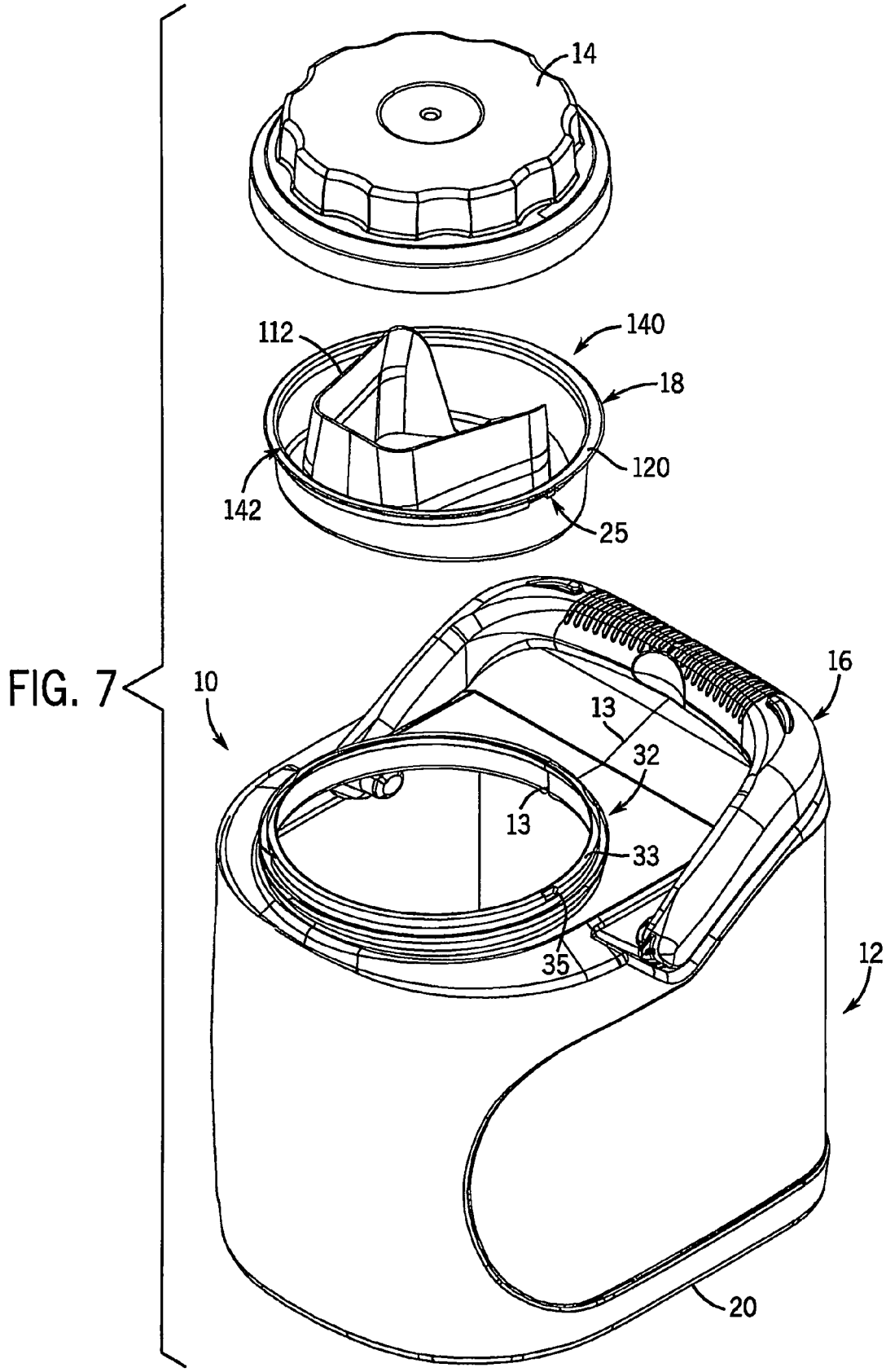
FIG. 7 is an exploded perspective view of an exemplary embodiment of a container including a container sealing system having an insert with a flat portion having a first radius and a second portion having a second radius and including an indexing tooth/notch combination.
Figure 8:
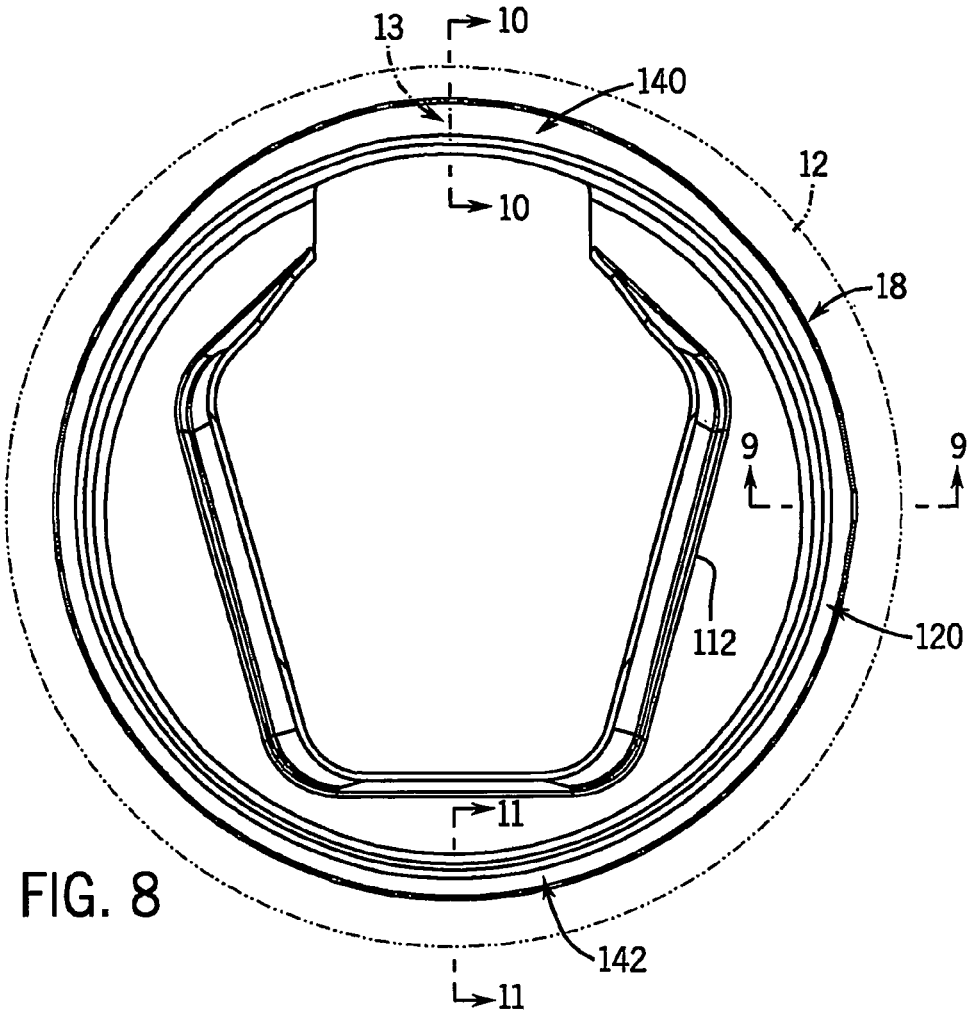
FIG. 8 is a top plan view of an exemplary embodiment of an insert for a container, with the insert having a first portion having a first radius and a second portion having a second radius, with the first radius larger than the second radius.

Referring to FIGS. 3, 5 & 6, spout insert 18 includes an outer wall 110, a spout 112, and a bottom wall 114. Outer wall 110 is configured to slide into neck 32 and includes features (described below) to hold insert 18 within neck 32. According to one embodiment, outer wall 110 is a substantially cylindrical wall that defines the periphery of spout insert 18 and that includes an upper edge 116 and a lower edge 118. A lip 120 extends radially outwardly from upper edge 116, and serves as a stop to prevent insert 18 from being pushed too far into, or through, neck 32. The lip 120 extends up to but does not extend past or over the upper edge 33 of the neck 32. The interface between the upper edge 33 of the neck 32 and the lip 120 of the spout insert 18 forms a seal as the cover 14 is threaded onto the neck 32 of the container 10. A radially outwardly extending protrusion 122 extends around the periphery of outer wall 110, and is configured to engage a corresponding groove (not shown) provided on the inside of neck 32. The engagement of protrusion 122 and the corresponding groove serves to hold spout 18 into the proper vertical position with respect to container 10.

Figure 4:
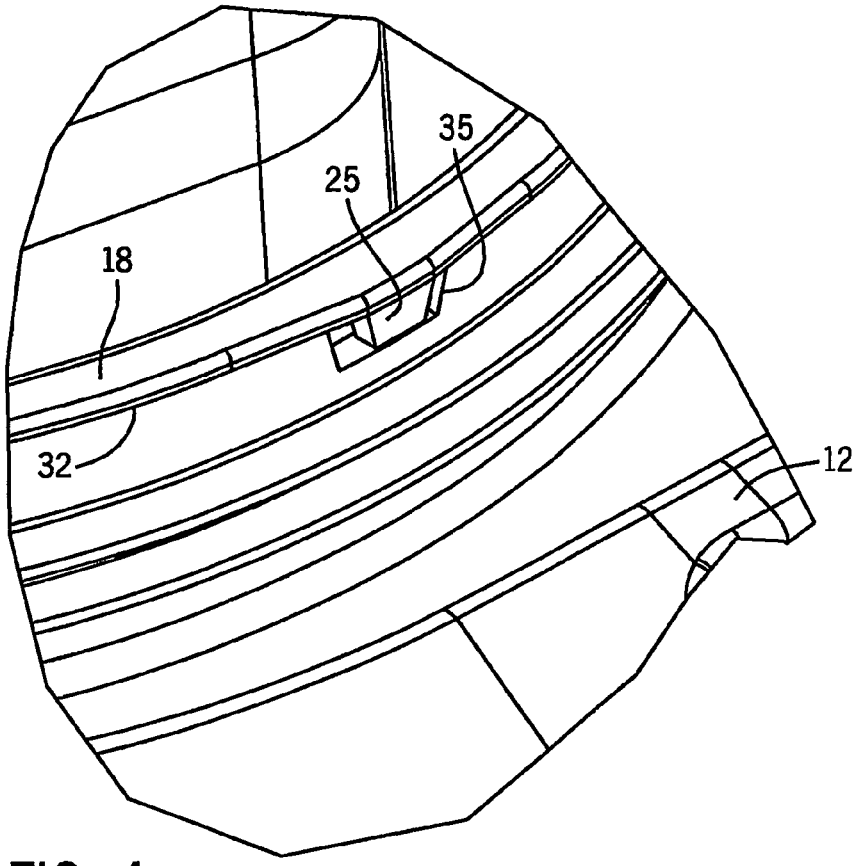
FIG. 4 is a partial detail view of the notch illustrated in FIG. 3 with a tooth formed on the spout insert engaged in the notch.
Figure 9:
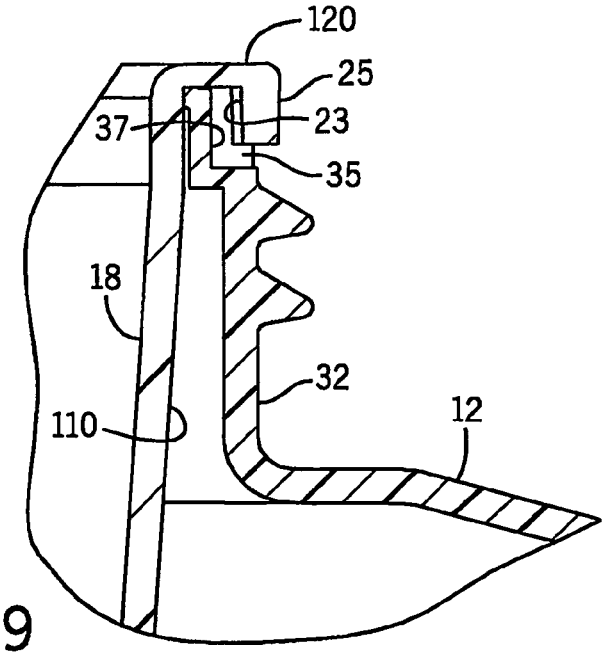
FIG. 9 is a partial sectional view of the insert illustrated in FIG. 8 along the line 9-9.
Figure 10:
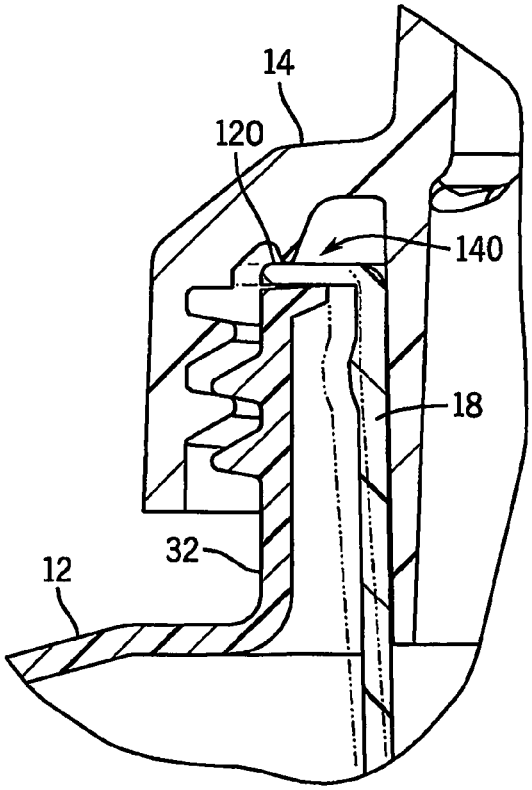
FIG. 10 is a partial sectional view of the insert illustrated in FIG. 8 along the line 10-10 and illustrating the first portion of the lip of the insert.
Figure 11:
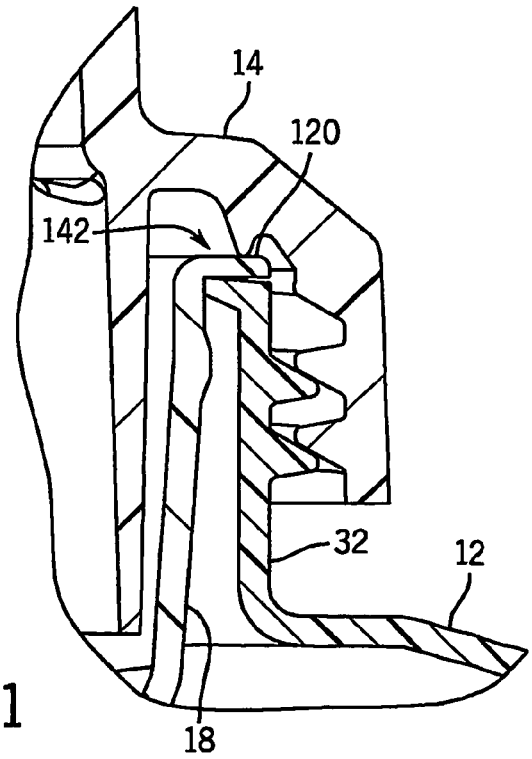
FIG. 11 is a partial sectional view of the insert illustrated in FIG. 8 along the line 11-11 and illustrating the second portion of the lip of the insert.

The spout insert 18 also includes a protrusion or tooth 25 configured to engage, for example by insertion, a corresponding pocket or notch 35 formed in the neck 32 (See FIGS. 3 & 4.). The tooth 25/notch 35 configuration prevents rotation of the spout insert 18 and also functions as an index to align the spout insert 18 with the container 10 for decanting the contents of the container 10. A typical alignment is for the spout 112 of the spout insert 18 to be aligned with the center line of the container 10 rear wall 24 as best seen in FIG. 2. It should be understood that the tooth 25 may be formed on the neck 32 and the notch 35 formed in the spout 18. It should also be understood that the tooth 25/notch 35 configuration may be located at any convenient location along the periphery of the neck 32. The tooth 25/notch 35 combination also aligns the spout insert 18 so that an extended portion of the lip 120 aligns with the knit line 13 on the container 10 as more fully discussed below. The tooth 25 is integrally formed on the underside of the lip 120 a spaced distance from the outer wall 110 of the insert 18. With the insert 18 installed in the container 10, the tooth 25 inserts into the notch 35 with a space between the inner surface 23 of the tooth 25 and outer surface 37 of the notch 35. (See FIG. 9)

According to alternative embodiments, the outer wall may include other features to prevent the insert from being pushed too far into the neck of the container and/or to hold the insert in the neck. For example, the insert may include threads on the outer wall that engage threads provided on the inside of the neck when the insert is screwed into the neck. The insert may also be coupled to the neck using a frictional-type fit, spin-welding, adhesives, or any of a wide variety of other techniques and methods known in the art.

Spout 112 is provided within the periphery of insert 18 (e.g., spout 112 is inside of, and spaced apart from, outer wall 110) and is generally configured to facilitate the pouring of the contents (e.g., paint or other fluids) from container 10. The walls of the spout 112 each may have straight upper edges, over which the contents of container 10 (e.g., liquid coating materials such as paint, varnish, etc.; water; liquids; or other substances) are poured when the contents of container 10 are removed using spout 112. The straight upper edges may also be used as brush wipes to wipe excessive paint off of a brush.

Bottom wall 114 extends between outer wall 110 and spout 112 and serves to couple lower edge 118 of outer wall 110. A channel 162 is thereby formed by outer wall 110, bottom wall 114, and spout 112 that extends around insert 18 between outer wall 110 and spout 112. An aperture 164 is provided in channel 162 partially in bottom wall 114 and partially in the lower portion of outer wall 110) at a location opposite wall 126. Aperture 164 is configured such that substances (such as paint, for example) that enter channel 162 can pass through aperture 164 and drain back into body 12 of container 10. In order to direct any substances that may enter channel 162 toward aperture 164, channel 162 slopes toward aperture 164. To enable channel 162 to slope toward aperture 164, lower edge 118 of outer wall 110; lower edges of walls of the spout 112, and bottom wall 114 are also sloped as needed to allow channel 162 to slope toward aperture 164.

As shown in FIGS. 1 and 2, spout insert 18 is preferably coupled to container 10 in such a way that wall 126 is proximate back wall 24 of body 12 (e.g., such that wall 126 is the back most portion of spout 112). In such a configuration, a user of container 10 may grasp handle 16 with one hand and the bottom of container 10 (more particularly, bottom recess 52, the finger recess, and/or the recess channel) with the other hand and pour paint (or other material contained within body 12) from spout 112 over straight upper edge and over back wall 24 of container 10. Once container 10 is returned to an upright position, any paint that may have entered channel 162 (such as during pouring or while wiping a paint brush against one of the straight edges of spout 112) will flow toward aperture 164 and pass back into body 12 of container 10. Channel 162 thereby reduces the likelihood that excess paint will drip down the side of container 10, which may hamper the ability to read any label that may be provided on container 10 and which may allow paint to get on surfaces for which the paint was not intended. A gap provided in spout 112 may also serve to allow paint that enters channel 162 to pass back into body 12. If one desires to use the paint directly from container 10, the user may simply apply paint to his or her paint brush by inserting the paint brush into body 12 between walls of spout 112. Straight upper edges of the spout can then be used to wipe any excess paint from the brush. When finished using the paint, the user simply replaces cap 14. The walls of the spout 112 may be higher than the upper edge 116 of the neck 32 or the walls may be below or at the same elevation as the upper edge 116 of the neck 132.

Referring to FIGS. 6-11, spout insert 18 includes an outer wall 110, a spout 112, and a bottom wall 114. Outer wall 110 is configured to slide into neck 32 and includes features (described below) to hold insert 18 within neck 32. According to one embodiment, outer wall 110 is a substantially cylindrical wall that defines the periphery of spout insert 18 and that includes an upper edge 116 and a lower edge 118. A lip 120 extends radially outwardly from upper edge 116, and serves as a stop to prevent insert 18 from being pushed too far into, or through, neck 32. The lip 120 extends up to but does not extend past or over the upper edge 33 of the neck 32.

The lip 120 of the spout insert 18 includes a first portion 140 having a first radius and a second portion 142 having a second radius. The first radius is larger than the second radius. See FIGS. 8, 10 and 11. The first portion 140 is an extended portion that is aligned with the knit line 13 on the container 10. A knit line 13 is formed during the molding process of the container 10. Material tends to build-up along the knit line 13 Such material build-up inhibits or prevents the spout insert 18 from forming a good seal as the container cap 14 is screwed onto the neck portion 32 of the container 10. The downward and lateral forces exerted by the cap 14 on the neck 32 and insert 18 tend to move the lip 120 inward near the knit line 13 creating a gap or misalignment preventing a seal from being formed. The extended lip, the first portion 140 of the lip 120, of the insert 18, avoids a gap from forming between the insert 18 and cap 14. (See FIG. 10)

The tooth 25/notch 35 combination function to insure that the first portion 140 of the lip 120 aligns with the knit line 13 of the container 10 so that a seal can be formed at that location. It should be understood that the knit line 13 can be formed at any location on the container, therefore the tooth 25/notch 35 combination must be positioned to assure proper alignment of the first position 140 of the lip 120 with the knit line 13. For purposes of this application, the term "knit line" shall mean that junction formed during the molding process of the container, typically at the mating line between the two halves of the mold used to form the container.

In one embodiment, the spout 18 is composed of linear low density polyethylene (LLDPE), which will deform as the cap 14 is threadingly attached to the container 10 to form a seal. (See FIG. 5.) LLPDE is a narrow molecular weight distribution copolymer that tends to resist stress cracks and is flexible. An example of a linear low density polyethylene is Dowlex® 2517. In another embodiment, the lip 120 includes an overmold 123 of material composed of thermoplastic elastomer, which will deform as the cap 14 is threadingly attached to the container 10 to form a seal. The cap 14 and the container 10 material composition is typically harder than the material composition of the spout 18. In both such embodiments, the material compression on the container upper edge 33 seals the container and accommodates irregularities in the container 10 and cap 14.

The interface between the upper edge 33 of the neck 32 and the lip 120 of the spout insert 18 forms a seal as the cover 14 is threaded onto the neck 32 of the container 10. A radially outwardly extending protrusion 122 extends around the periphery of outer wall 110, and is configured to engage a corresponding groove (not shown) provided on the inside of neck 32. The engagement of protrusion 122 and the corresponding groove serves to hold spout 18 into the proper vertical position with respect to container 10.

According to various alternative embodiments, the spout insert may take any one of a plurality of different configurations. For example, any one or more of the walls of the spout may extend vertically upward or may be angled either toward or away from the center of the spout as they extend upwardly. Furthermore, the upper edges of the walls may have the same elevations, or they may different elevations. Moreover, the elevation of the upper edge of any one or more of the walls of the spout may vary along the length of the wall, or it may be constant. For example, the upper edge of one or more of the spout walls may be level or it may have an increasing or decreasing elevation. The walls may also be configured such that the upper edge of the spout, as a whole, is level or such that it increases and/or decreases in elevation. Additionally, the elevation of the walls of the spout may vary with respect to the height of the outer wall or with respect to the height of various parts of the container. Thus, the upper edge of one or more of the spout walls may extend above, below, or be even with the upper edge of the outer wall, the upper edge of the neck of the container, and/or the edge of some other feature of the container. According to still other alternative embodiments, the lower edge of any one or more of the spout walls may be straight, curved, arced, or may have some other shape. Moreover, the length of any one or more of the spout walls may vary. The overall size and shape of the spout may also vary. For example, the spout may be configured to allow a variety of different sized paint brushes to pass through the spout and into the body of the container. According to another alternative embodiment, any one or more of the upper edges of the walls of the spout may have a comb-like configuration intended to comb excess paint from paint brushes. According to another alternative embodiment, the spout insert may be integrally-formed with the container. According to yet another alternative embodiment, the spout insert may not include an outer wall or a channel, but rather, may be comprised of one or more walls coupled together to form a spout. According to still other alternative embodiments, the spout insert may include only one of the aperture provided in the channel and the gap provided in the spout. According to other alternative embodiments, the transition between one or more of the walls of the spout may be a sharp, distinct corner; it may have a radius; it may be tapered or beveled; or it may have some other gradual or abrupt transition. According to other alternative embodiments, the container may include an opening on a side other than its top side and may include a spout insert within such opening. It should be noted that references to "upper," "lower," "top," "bottom," "height," and/or "elevation" refer to certain portions, positions and/or dimensions of the spout (and other parts of the container) as they would appear when the container is placed as intended on a retail shelf. However, it should be understood that these references apply equally to spout inserts (and other parts of the container) that are oriented differently. Thus, the "elevation" of the upper edge of a spout that extends horizontally out of the side of a container would be the same as the "elevation" of an identical spout extending vertically from the top of a container.

The cap 14 serves both as a cover and a dish for material held in the container, for example, paint. The cap 14 includes a downwardly extending wall that extends from the top of the cap between the spout insert 18 and the neck 32 of the container 10. The cap 14 may include internal threads that threadably engage threads 34 formed on the neck 32. The cap 14 can be configured to receive a molded logo, a clear window to see the interior of the container 10, or other indicia to identify the contents in the container. The cap 14 may be formed by two or more materials, for example a rubber based, thermoplastic elastomer, polypropylene, or other type of plastic or elastomer using a two-shot or bi-injection molding process. The cap 14 can be configured to provide a portion of a second material to extend into recesses 59 formed on the outer periphery of the cap 14, which may assist the user in gripping and manipulating the cap 14 on and off the container 10. Various textures maybe molded into the second material and different colors of the material may be employed during the molding process.

Further modifications may be made in the design, arrangement and combination of the elements without departing from the scope of the invention. For example, a top member including one or more of the features discussed above such as the spout, reclamation structure or channel, and others may be integrally formed with the body member or may be fastened to the container as a separate component. Additionally, the container may include transparent areas to allow the user to see the contents of the container. Further, the cap attachment may include a transparent area to indicate whether the cap is securely attached to the container to prevent paint from accidentally being spilled. Although the container has been referred to as a paint container, other liquids may be stored and poured as well. While some of the features have a unique application to the storage and application of paint, other features may be used for other liquids as well. Additionally, the label that is applied to the container may include a blank white portion to permit the user or manufacturer to dab or paint a sample of the paint in the container to clearly show what color is contained within the container and how it will appear when painted on a white background. It is also noted that the features described in the specification and shown in the Figures either alone or in combination may also be combined with individual or multiple features disclosed herein or in the priority applications noted above. These and other modifications may be made in the design, arrangement and combination of the elements without departing from the scope of the invention as expressed in the appended claims.

What is claimed is:

1. An insert for a container having a knit line on the container body, a neck defining an opening in the body and a cover configured to threadingly engage the neck, the insert comprising:

an outer wall configured to fit within the opening of the container and defining the periphery of the insert, the outer wall having an upper edge and a lower edge, with the upper edge including an annular lip extending radially outward to prevent the insert from being pushed to far into or through the neck;

an upstanding spout located within the outer wall; and a bottom wall connecting the lower edge of the outer wall and the spout to form a channel between the outer wall and the spout, wherein the lip includes a first portion having a first radius and a second portion having a second radius, wherein the first radius is larger than the second radius with the first portion forming a seal at the knit line of the container when the cover is threaded onto the neck.

2. The insert of claim 1, including a tooth extending from the lip and configured to insert into a notch defined by the neck of the container.

3. The insert of claim 2, wherein the tooth is a spaced distance from the outer wall of the insert.

4. The insert of claim 1, wherein the insert is composed of linear low density polyethylene.

5. The insert of claim 1, wherein the lip forms a gasket seal with neck as the cover is threaded onto the neck.

6. The insert of claim 1, wherein the channel includes an aperture.

7. The insert of claim 6, wherein the channel is sloped toward the aperture.

8. The insert of claim 1, wherein the spout includes at least one straight upper edge.

9. An insert for a container having a body defining a volume, a neck defining an opening in the body and a cover configured to threadingly engage the neck, the insert comprising:

an outer wall configured to fit within the opening of the container and defining the periphery of the insert, the outer wall having an upper edge including a lip extending radially outward from the upper edge to prevent the insert from being pushed to far into or through the neck and a lower edge, with the lip including one of a tooth and notch configured to engage one of the notch and tooth formed in the neck;

an upstanding spout located within the outer wall;

a bottom wall connecting the lower edge of the outer wall and the spout to form a channel between the outer wall and the spout, wherein the tooth/notch combination inhibits rotation of the insert in the opening and aligns the insert in a preselected orientation; and wherein the lip includes a first portion having a first radius and a second portion having a second radius, wherein the first radius is larger than the second radius with the first portion forming a seal with the neck at a knit line of the container when the cover is threaded onto the neck.

10. The insert of claim 9, wherein the tooth and notch are positioned to index the alignment of the spout in relationship to the body of the container.

11. The insert of claim 9, wherein the insert is composed of linear low density polyethylene.

12. The insert of claim 9, wherein the lip forms a gasket seal with neck as the cover is threaded onto the neck.

13. The insert of claim 9, wherein the channel includes an aperture.

14. The insert of claim 13, wherein the channel is sloped toward the aperture.

15. The insert of claim 9, wherein the spout includes at least one straight upper edge.

16. A container having a knit line, the container comprising:

a body defining a partially enclosed volume having an access opening defined by a neck, the neck defining a notch; and an insert coupled to the neck, the insert comprising:

an outer wall configured to fit within the opening of the container and defining the periphery of the insert, the outer wall having an upper edge and a lower edge, with the upper edge including an annular lip extending radially outward to prevent the insert from being pushed to far into or through the neck;

a tooth extending from the lip and configured to insert into the notch defined by the neck of the container;

an upstanding spout located within the outer wall; and a bottom wall connecting the lower edge of the outer wall and the spout to form a channel between the outer wall and the spout, wherein the lip includes a first portion having a first radius and a second portion having a second radius, wherein the first radius is larger than the second radius with the first portion forming a seal at the knit line of the container when the cover is threaded onto the neck.

17. The container of claim 16, wherein the tooth is a spaced distance from the outer wall of the insert.

18. The container of claim 16, wherein the insert is composed of linear low density polyethylene.

19. The container of claim 16, wherein the lip forms a gasket seal with neck as the cover is threaded onto the neck.

20. The container of claim 16, wherein the channel includes an aperture.

21. The container of claim 20, wherein the channel is sloped toward the aperture.

22. The container of claim 16, wherein the spout includes at least one straight upper edge.

23. The container of claim 16, wherein the container is configured to contain paint.

24. A method for aligning and sealing a container having a knit line, a neck defining an opening in the container, and a cover configured to threadingly engage the neck, the method comprising the steps of:

providing an insert having an annular lip extending radially outward;

configuring the insert to fit within the opening of the container;

configuring the annular lip with a first portion having a first radius and a second portion having a second radius, wherein the first radius is larger than the second radius with the first portion forming a seal at the knit line of the container when the cover is threaded onto the neck;

providing a tooth on the annular lip; and configuring the tooth to insert into a notch defined in the neck, wherein the tooth/notch combination aligns the first portion of the insert with the knit line of the container.

25. The method of claim 24, including the step of configuring the insert to define a spout.

26. The method of claim 24, wherein the insert is composed of linear low density polyethylene.

27. The method of claim 24, wherein the container is configured to contain paint.

* * * * *